US006135189A

United States Patent [19]

Weinreich

[11] Patent Number: 6,135,189

[45] Date of Patent: Oct. 24, 2000

[54] MECHANISM FOR CONSTANT BALANCE

[76] Inventor: Steve Weinreich, 14 Norton Rd., Monmouth Jct., N.J. 08852

[21] Appl. No.: 09/122,142

[22] Filed: Jul. 24, 1998

Related U.S. Application Data

[60] Provisional application No. 60/053,894, Jul. 28, 1997, provisional application No. 60/053,957, Jul. 28, 1997, and provisional application No. 60/053,997, Jul. 28, 1997.

[51] Int. Cl.[7] ..... E05F 11/00

[52] U.S. Cl. ..... 160/191; 160/171 R

[58] Field of Search ..... 160/170 R, 171 R, 160/84.02, 176.1 R, 177 R, 173 R, 315, 168.1 R, 84.06, 191

[56] References Cited

U.S. PATENT DOCUMENTS

| | | | |
|---|---|---|---|
| 2,032,951 | 3/1936 | Pixley | 160/191 |
| 2,055,511 | 9/1936 | Twiss | 160/310 X |
| 2,250,106 | 7/1941 | Lorentzen | 160/171 R X |
| 2,350,286 | 5/1944 | Michelman . | |
| 2,420,301 | 5/1947 | Cusumano . | |
| 2,520,629 | 8/1950 | Esposito | 160/171 R |
| 2,687,769 | 8/1954 | Gershuny | 160/170 R |
| 2,687,770 | 8/1954 | Walker et al. | 160/176.1 R |
| 3,100,013 | 8/1963 | Randmark | 160/176.1 R X |
| 3,294,153 | 12/1966 | Fountain | 160/176.1 R X |
| 4,673,018 | 6/1987 | Judkins | 160/84.06 |
| 5,078,198 | 1/1992 | Tedeschi | 160/315 |
| 5,103,888 | 4/1992 | Nakamura | 160/171 R |
| 5,133,399 | 7/1992 | Hiller et al. . | |
| 5,437,324 | 8/1995 | Sternquist | 160/317 X |
| 5,531,257 | 7/1996 | Kuhar . | |

*Primary Examiner*—David M. Purol

[57] ABSTRACT

Constant balance of a varying load, particularly a window shade or blind, is maintained by providing a lifting force, preferably from a spring, through a mediating mechanism comprising a variable pitch screw assembly, such that the mechanical advantage of the mediating mechanism changes to allow the continuously decreasing spring force to apply an appropriate lifting force at all times. A variable pitch screw thread is formed as grooves in a cylindrical blank. The grooves are engaged by pins in a nut which thereby accomodates the variable pitch of the screw. A compact blind tilting mechanism is also incorporated. The capacity of the mechanism can be increased by linking several screw assemblies.

10 Claims, 8 Drawing Sheets

MECHANISM FOR CONSTANT BALANCE

Elements of this Invention were also disclosed in Provisional Patent filings:

IMPROVED BALANCING MECHANISM 60/053,894

BALANCING BAR 60/053,957

VENETIAN BLIND TILTER 60/053,997, all filed Jul. 28, 1997, for which I claim priority.

This Invention is related to my patent application Ser. No. 08/794,872, MECHANISM FOR CONSTANT BALANCE, filed Feb. 5, 1997, now U.S. Pat. No. 6,003,584 which is incorporated herein by reference.

BACKGROUND AND OUTLINE OF THE INVENTION

The copending Application, MECHANISM FOR CONSTANT BALANCE, discloses a mechanism used to balance one force against another, where the ratio between the forces varies in a predictable way. The present Invention incorporates much of the teaching of the copending Application.

It is known in the art to use springs to assist the raising of changing loads, particularly window shades and blinds. Michelman U.S. Pat. No. 2,350,286 has structural similarity to the present Invention, but does not track the changing load.

Patents disclosing spring assists arranged to track the changing load include those using fusees (tapered sheaves) to mediate between spring and load, such as Cusumano, U.S. Pat. No. 2,420,301 and Hiller et al, U.S. Pat. No. 5,133,399. Kuhar, U.S. Pat. No. 5,531,257, uses a modified "constant force" spring to provide a variable tracking force.

The copending Application describes a mechanism which preferably comprises a variable pitch screw and a nut. The preferred screw form is a twisted rectangular bar. In the present Invention, the bearing surface of the screw is expanded to reduce the force per unit area imposed on the screw material.

An alternate screw form, mentioned in the copending Application, is preferred for some embodiments of the present Invention. Particularly for custom or short-run applications, the alternate screw form is more easily manufactured.

The copending Application discloses a compact embodiment, particularly for use with roller shades. In the present Invention, the compact embodiment is modified, particularly for use with venetian blinds and other loads which increase as they are lifted. The present Invention better transfers force from the screw to the support structure in such applications.

The copending Application does not particularly address the tilt mechanism commonly associated with venetian blinds. The preferred compact embodiment of the present Invention includes a low profile tilt mechanism. The preferred tilt mechanism also allows lift cords to be run more directly to the cord winder of the Invention.

The present Invention incorporates a preferred bottom bar, preferably for venetian blinds, which allows convenient balance adjustment.

A preferred embodiment of the present Invention, particularly used with heavy loads, includes a linkage to insure parallel operation of a plurality of screw assemblies.

DRAWINGS

Figure 7C:
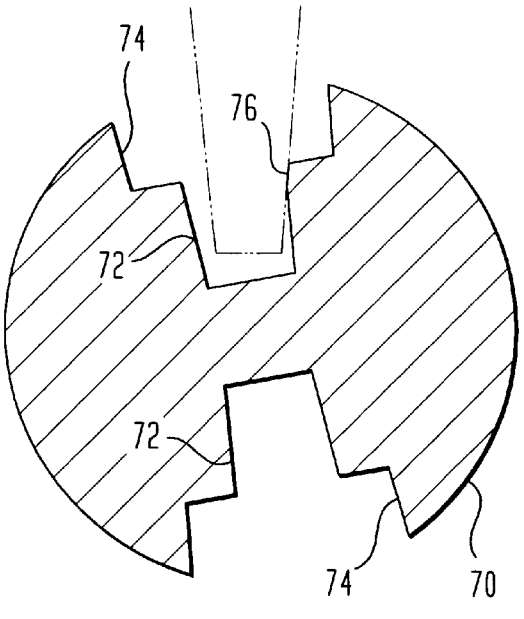
Figure 7B:
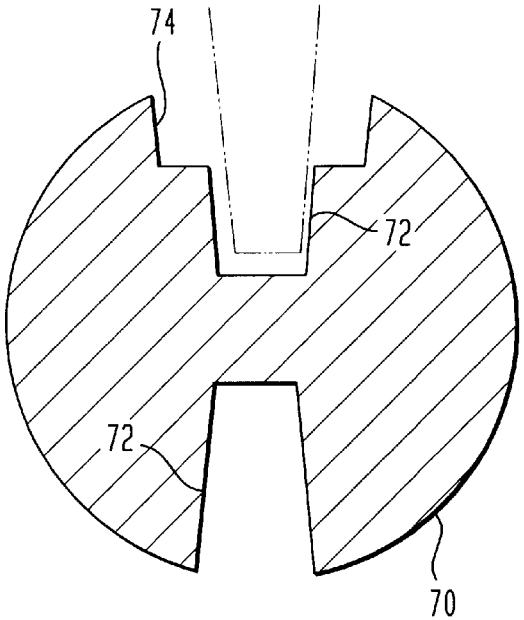
Figure 7A:
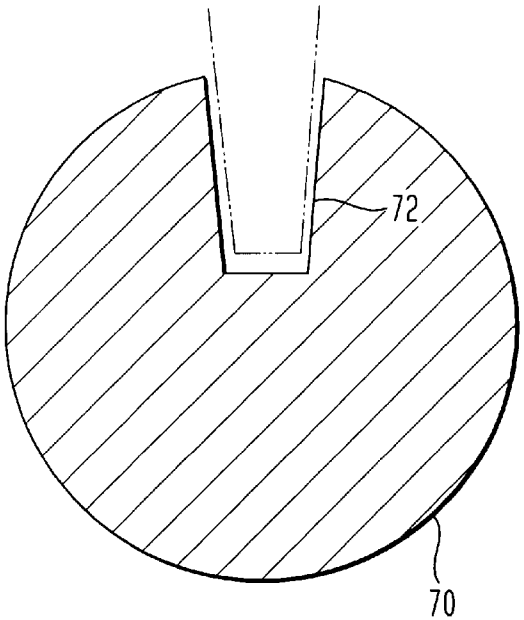

FIGS. 7A, 7B, and 7C show stages in forming a screw of an alternate shape.

Figure 8:
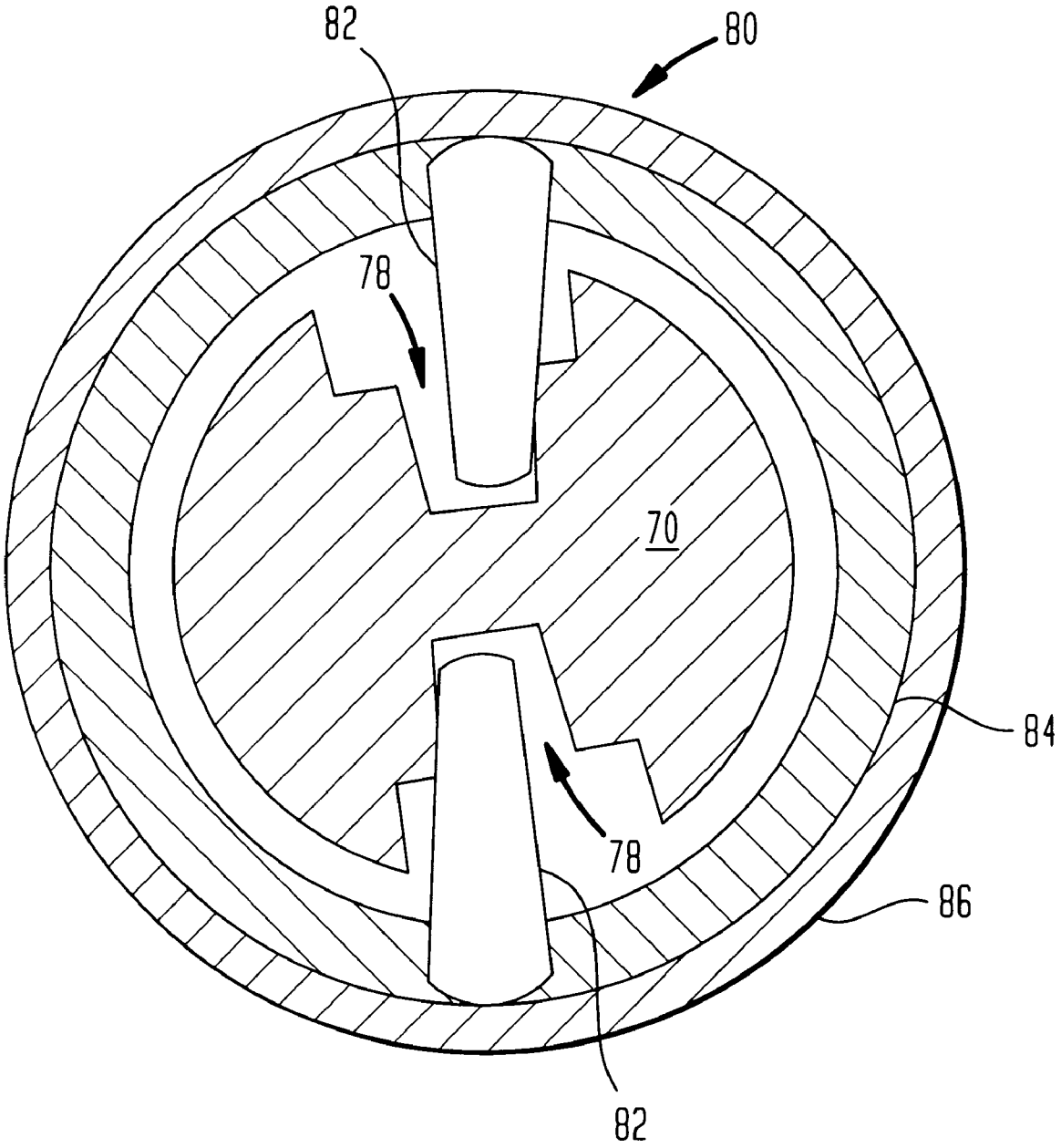

FIG. 8 is a cross section of the alternate screw and its associated nut.

Figure 1:
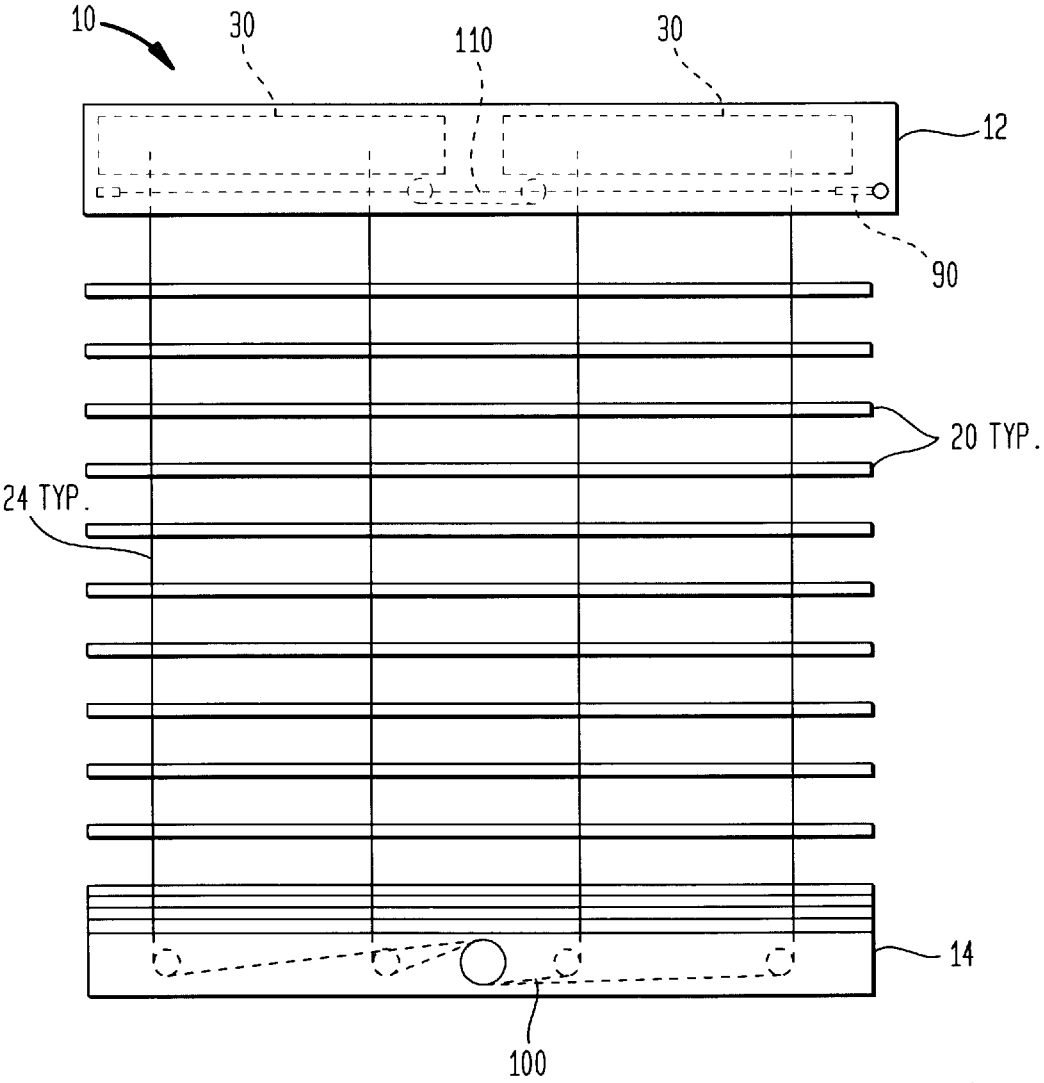
FIG. 1 is a front section-elevation of a typical venetian blind fitted to the headrail and bottom bar of the Invention.
Figure 9:
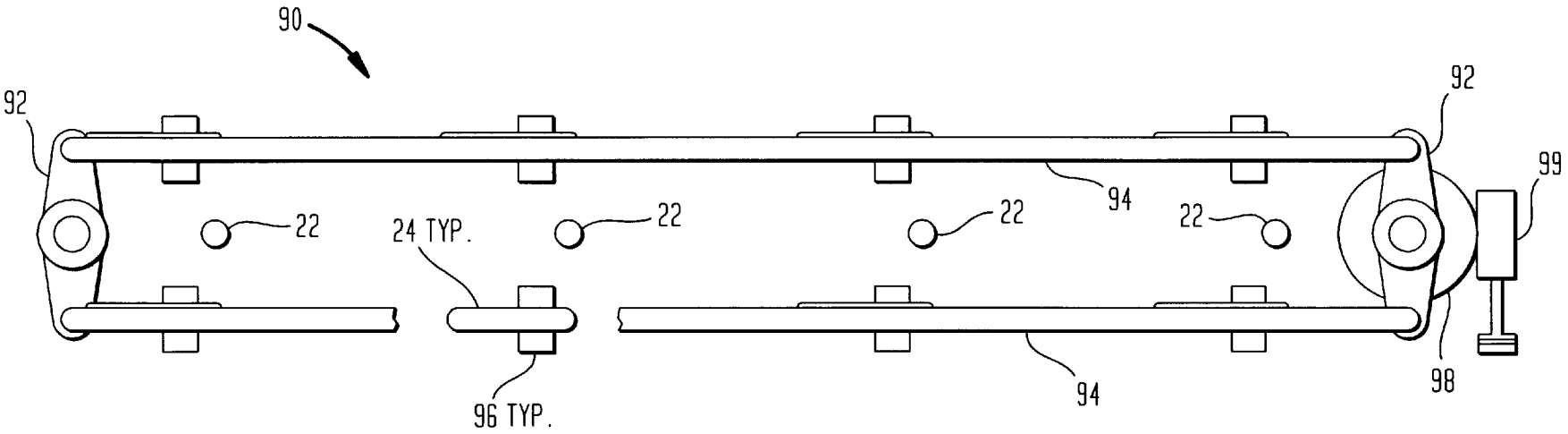

FIG. 9 is a plan view of the venetian blind tilter shown in FIG. 1.

Figure 10:
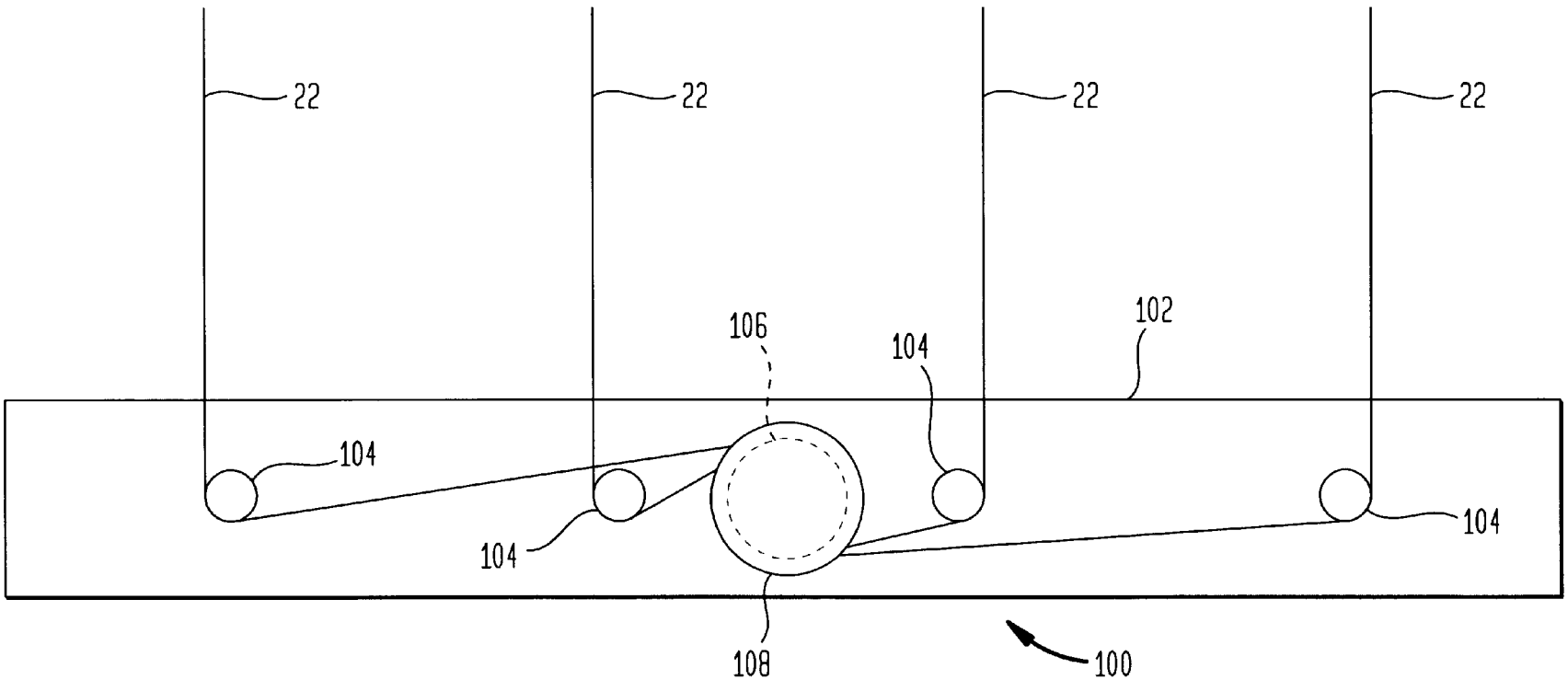

FIG. 10 is a front elevation-section of the bottom bar shown in FIG. 1.

Figure 11:
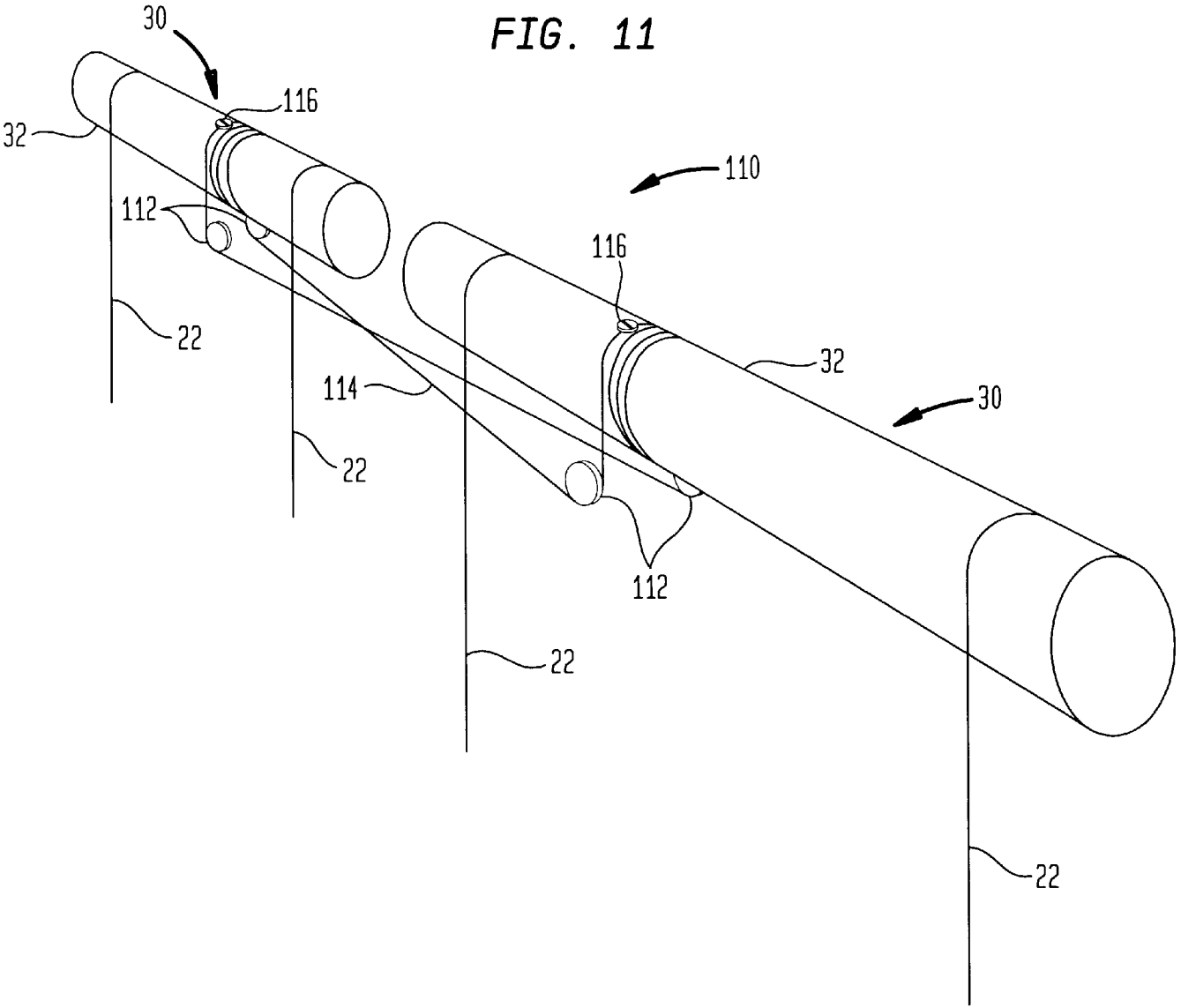

FIG. 11 is a perspective diagram of a linkage, shown in FIG. 1, between two screw assemblies.

DESCRIPTION OF THE INVENTION

Figure 2:
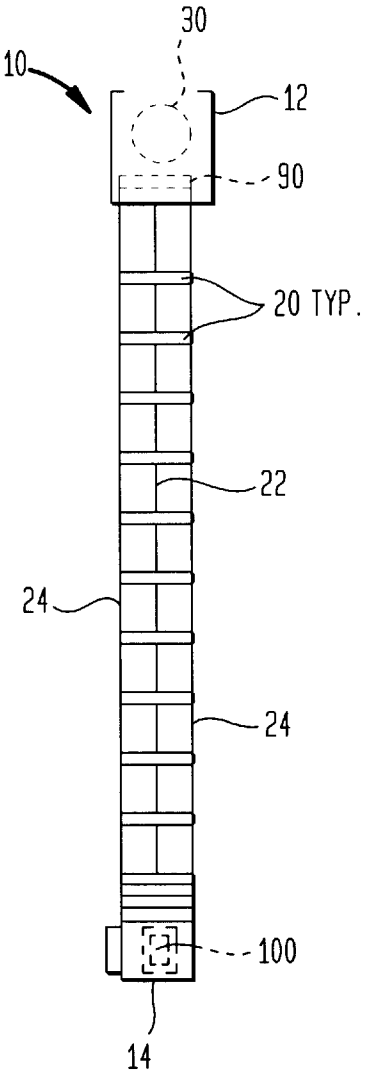
FIG. 2 is a side section-elevation of the apparatus shown in FIG. 1.

FIGS. 1 and 2 show ordinary venetian blind slats 20, with ladders (or tilt cords) 24 and lift cords 22, installed between the headrail 12 and bottom bar 14 of the invention 10.

The headrail 12 comprises two constant balance screw arrangements 30 to maintain the blind in balance as it is raised and lowered, a linkage 110 to assure their synchronization, and a compact tilter 90.

The bottom bar 14 comprises a balance adjusting assembly 100.

Operation of the Preferred Embodiment

Torque Transfer

In preferred embodiments of the Invention of the copending Application, a common extension spring (or springs) urges a nut to translate along a screw. In practice, the screw is usually far shorter than the spring (when the spring is extended to working length) and is positioned near one end of the spring. According to the copending Application, the profile of the screw may be tapered.

In embodiments designed to lift loads that increase as they are lifted, the tapered profile will be smaller at that end of the screw farthest from the far spring anchor. In such embodiments, the greatest torque imposed on the screw is when the nut is positioned at the larger end.

Figures 3, 4, 5:
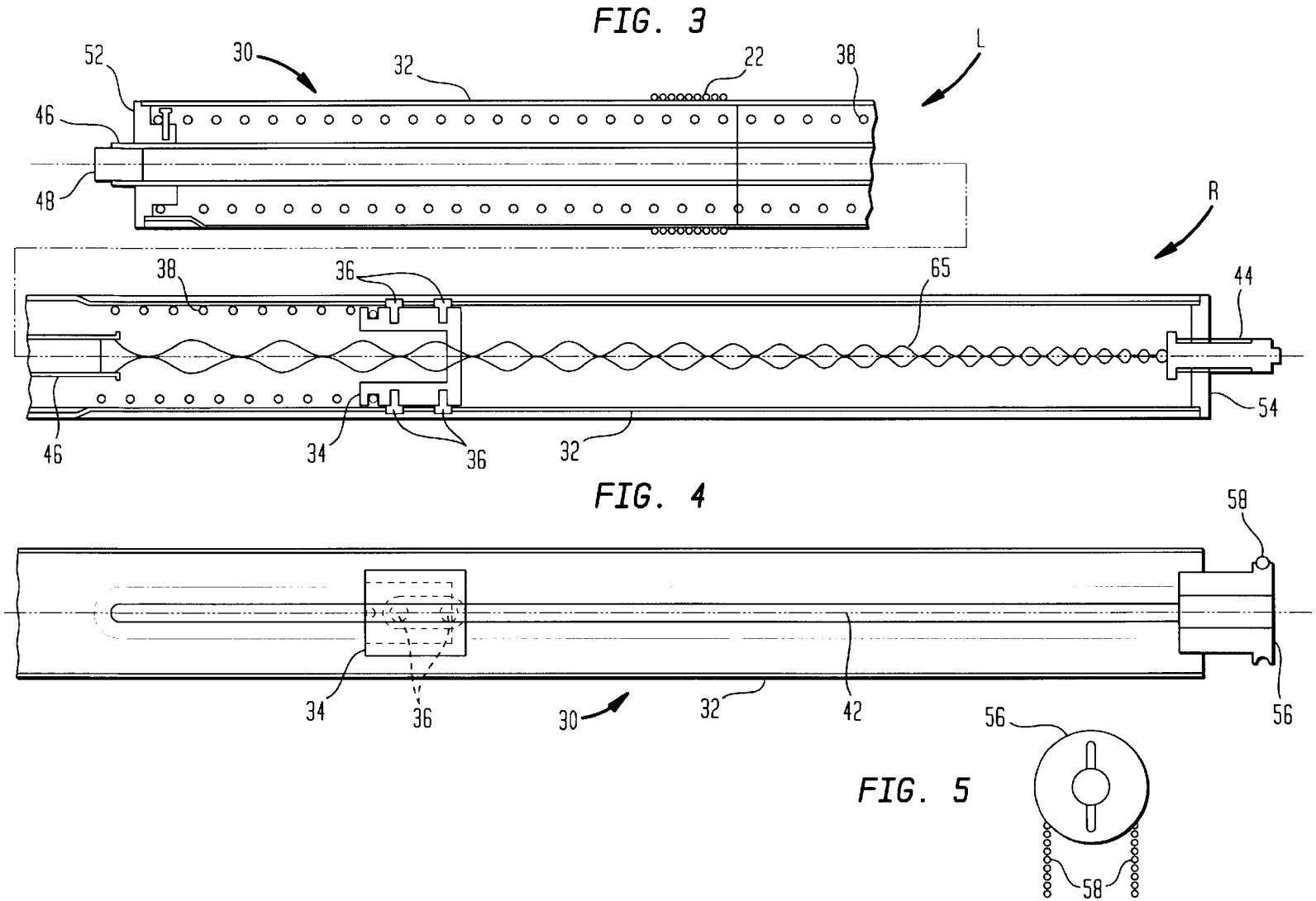
FIG. 3 shows the Left and Right portions of a longitudinal section through the centerline of a screw assembly shown in the headrail of FIG. 1.
FIG. 4 is the longitudinal section of FIG. 3R, rotated 90° about the longitudinal axis.
FIG. 5 is an end view of the optional bead chain sprocket shown in FIG. 4.

Torque should, therefore, preferably be applied at the large end of the screw. This serves to transmit as little torque as possible through the length of the screw. It also eliminates (or greatly reduces) torque applied at the small end mounting. As shown in FIG. 3, the screw 65 may be extended at its larger end, preferably by a relatively stiff tubular screw extension 46.

The compact design of screw assembly 30, shown in FIGS. 3, 4, and 5, in large part follows the teaching of the copending Application.

Screw 65 is rigidly mounted at one end (or may be integral with) a stub shaft 44. The stub shaft 44 is in turn rigidly mounted to a support (not shown) in the headrail. The other end of screw 65 is rigidly connected to (or may be integral with) tubular screw extension 46, preferably a (lightweight and torsionally rigid) tube. Screw extension 46 is, at its other end, fitted with a plug 48 which is rigidly mounted to a support (not shown) in the headrail.

A tube 32, for winding lift cords 22 of the venetian blind, has end caps 52 and 54 fitted into its ends. End cap 52 is rotatably mounted about screw extension 46 and is free to slide longitudinally thereon. End cap 54 is fitted to a coarse machine screw thread on stub shaft 44. The machine screw thread causes tube 32 to translate longitudinally as it rotates so that the lift cords 22 of the venetian blind will be level wound.

Inside winding tube 32, an extension spring 38 is attached to end cap 52 and to a cup shaped nut 34 which is thereby drawn along screw 65 and caused to rotate.

The nut 34 engages slots 42 in the wall of winding tube 32 to rotate the winding tube and wind up lift cords 22.

With the screw 65 designed according to the teaching of the copending Application, the venetian blind can be raised or lowered merely by lifting or pulling down on its bottom bar. For some uses, particularly for blinds on tall windows or those with low sills, the optional bead chain sprocket 56 with bead chain 58 or other actuating devices (including motors) can be installed.

Increased Bearing Area

As can be derived from the teaching of the copending Application, it is possible to design similar embodiments of the invention with relatively large or relatively small screws. For the same load, a smaller screw will develop greater bearing forces at the points of contact between the screw and the nut.

In order to minimize material stress at the point of contact, the bearing area can be enlarged to result in reduced pressure per unit area in contact. One method to increase bearing area is to increase the number of bearing surfaces. A screw with more (similar) bearing surfaces will have greater bearing area. This can be arranged by changing the cross sectional shape of the screw from a rectangle to, e.g., a cross (like a Red-Cross or a plus sign). This also calls for a cross shaped hole in the nut.

It should be noted that the cross shaped screw needs less support to maintain concentricity with its associated nut than does the preferred screw of the copending application.

There is, however, a more preferred strategy for increasing the bearing area of the screw. Each bearing surface of the screw can be made surprisingly broad without adversely affecting operation of the screw and nut. The twisted, rectangular bar shape, preferred in the copending Application (and the cross shaped screw, disclosed above, and others), has a steeper lead angle nearer the axis and a shallower lead angle nearer the periphery. This can be easily understood with reference to a spiral staircase, which is steeper near its center post than it is near its railing.

Disregarding friction, the torque produced by a given axial spring force is the same, regardless of the radius at which the force is applied. The larger force component, that the steeper lead angle resolves nearer the axis, is exactly balanced by the reduced radius. The force will vary and the torque may vary as the spring relaxes and the nut moves along the screw. But there is a characteristic force-torque relationship for each section along the screw.

The screw shape can, therefore, be modified at any cross section by changing the bearing radius. Since that can be done, the bearing area can be extended toward and away from the axis without penalty. The force will simply be distributed across that area.

As taught in the copending Application, primarily due to friction, the lead angle of the screw is preferably between 30° and 60° to allow for forward or back driving. This does not change with the broadened bearing area. Therefore the inside and outside edges of the bearing areas along the screw should be constrained to comply with that requirement. In creating a screw design according to the disclosure of the copending Application, it will be helpful to use a more conservative angular range to allow for the bearing area to be widened.

The further application of this teaching is in the preferred method disclosed in the copending application to manufacture the screw. Provided the pitch of the screw is correct, the radius is not tightly constrained. Therefore, useful screws can be twisted from less sophisticated blanks. For example, a flat blank, tapered only in width may be devised to twist to an accurate pitch progression. Even though the screw diameter may deviate from a consistent progression, the screw will operate perfectly well as long as it is within operational (≈30° to 60°) lead angle limits.

Figure 6A:
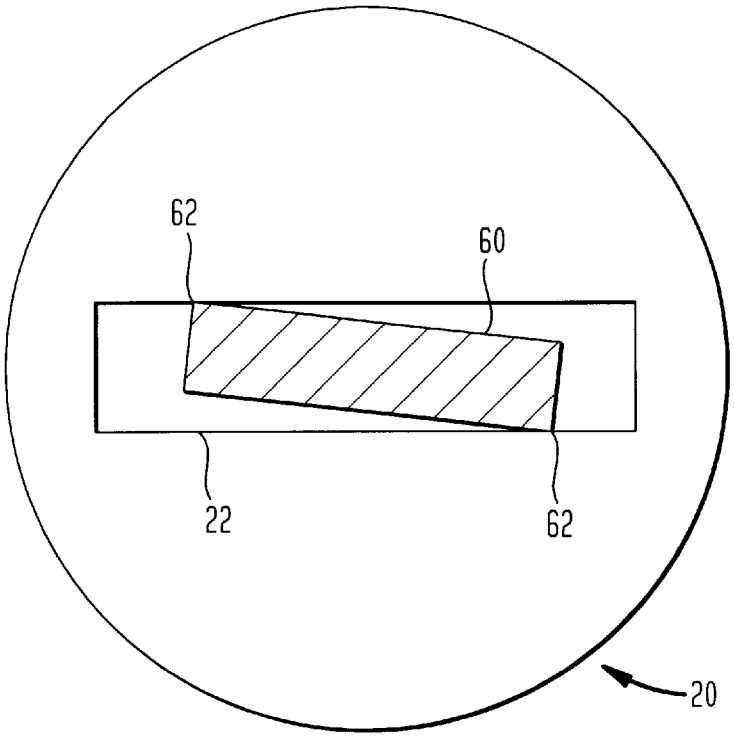
FIG. 6A is a cross section, taken at the nut, through the screw of the copending Application.

FIG. 6A shows the preferred screw 60 of the copending Application bearing against the slot 22 in nut 20. Bearing surfaces 62, the corners of the screw section, are small, causing the unit force on the surface of the screw 60 to be high.

Figure 6B:
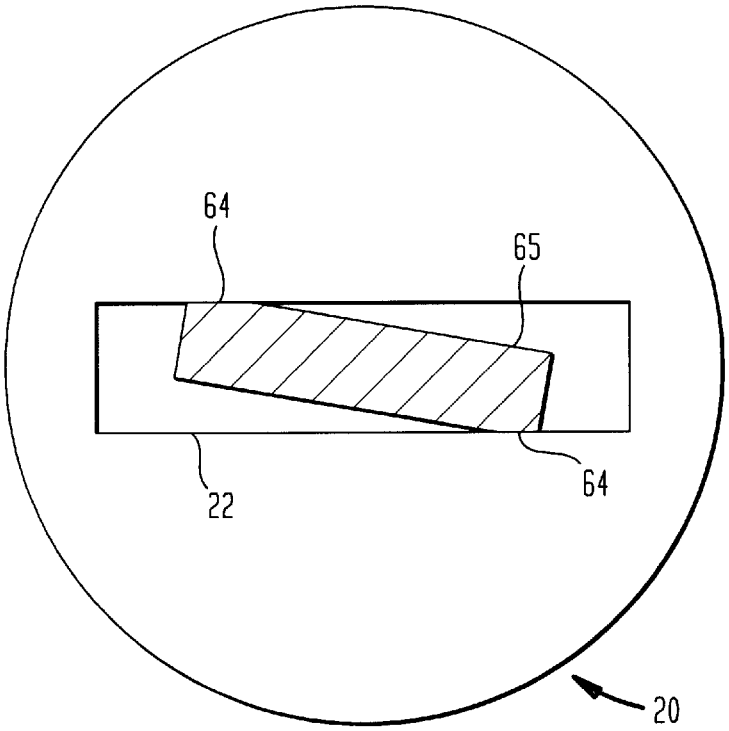
FIG. 6B is a cross section, taken at the nut, through the screw shown in FIG. 3R.

FIG. 6B shows a screw 65 with bearing surfaces 64 broadened (according to this disclosure) to spread the force across a greater area between the screw 65 and slot 22 of nut 20.

Alternate Screw Form

The copending Application briefly describes an alternate screw form:

> "Although the twisted bar is preferred, it will be obvious to one skilled in the art that there are other useful screw forms, each of which has an appropriate form for its nut or follower. For example, the screw may be a pair of (constant or variable) helixes (helices), offset 180 degrees from each other, milled into a cylindrical bar. In that case the nut preferably engages the screw with a pair of opposed pins."

The milled bar approach, however, does not readily accomodate a desired feature discussed in the copending Application under the heading "TOWARD MAXIMIZING THE LIFT RATIO":

> " . . . lift ratio may be increased by changing the contact radius along the length of the screw. The contact radius should increase as the pitch (or lead) angle increases. Thus the system will tend to maintain a more consistent pitch (or lead) angle then would be possible without the variation in contact radius."

For certain uses, particularly custom and short-run applications and those where the load varies irregularly (including most types of roll-up shades, doors, etc.), it is simpler to manufacture a screw of the milled bar type. The pins of the nut can be made to follow a track of varying radius.

The preferred alternate screw form is most easily understood by reference to one method of manufacturing it, although manufacture is possible by many other methods as well. A cylindrical bar of a suitably hard material (such as ordinary cold rolled steel) is selected such that the diameter of the bar is essentially equivalent to the maximum effective diameter of the screw to be made and the length is at least as great as the length of the screw to be made. Calculation of the maximum dimensions as well as the required bearing radius at each point along the screw and other details are addressed in the copending Application.

Although, as will be apparent from the disclosure, a tapered bar can be used as a blank, a cylindrical bar is preferred. The cylindrical bar is more readily supported during manufacture as the support(s) may be of constant height. The screw cut into the cylindrical bar will be stronger as there will be more material in the finished screw. The cylindrical bar is more readily prepared from raw stock.

The cylindrical bar is preferably mounted to a computer controlled rotary table, the bar projecting from the center of the rotary table. The rotary table is in turn mounted (with its working surface vertical) to the table of a computer controlled vertical milling machine, the bar projecting parallel to the long axis of the table. The axis of the bar is preferably centered below the center of the milling head. A support is preferably provided at the end of the bar opposite the rotary table. An additional support may be arranged below the milling head and attached to the body of the machine such that the additional support does not travel with the table, but remains stationary as the bar moves over it.

Referring to FIGS. 7A, 7B, and 7C, a preferably slightly tapered mill is used to cut a slot or groove 72 of constant depth beginning near one end of the screw blank (or bar) 70 and progressing to the opposite end. The maximum diameter of the tapered mill is preferably less than about one quarter of the diameter of the bar. The slot is made sufficiently deep so that it reaches the minimum required bearing radius. Simultaneously, the bar is rotated by the rotary table so that the slot wraps around the bar according to the requirements of the work-in/work-out screw calculations as described in the copending Application.

After another, preferably identical, slot (or slots) is cut at preferably equal angles around the workpiece, the workpiece is returned to its starting position. The mill is replaced with one of larger diameter. The bar 70 then retraces the same path as with the first mill. However, for the second cut 74 the table is raised or lowered along the way according to the requirements for bearing radii established in the screw calculations as described in the copending Application. The bottom of this second cut 74 follows the maximum radius of the desired bearing area for each point along the screw. In actual practice, each cut may be made in several passes.

In order to increase the bearing area to reduce unit area stress for the alternate screw, an additional mill cut can be taken. Using the first mill, the screw 70 is translated and rotated so that, for each point along the thread, the rotational position of the screw is slightly advanced from its previously calculated position.

The mill will cut a flat 76 to broaden the line of bearing. The considerations discussed above, regarding increasing the bearing area of the preferred screw of the copending Application, are also relevant here.

Referring to FIG. 8, the nut 80 of the type described (i.e., having opposed pins 82 to engage the slots 78 of the screw 70) must slide freely on the screw 70. The pins 82 are preferably shaped to match the first mill. In FIG. 8, the pins 82 (which may be ordinary taper pins) are fitted to tapered holes in a ring 84 and retained by retaining ring 86 to form the body of nut 80. Tapered pins 82 are preferably mounted to engage the screw 70 at slightly less depth than the mill. The pins 82 will, therefore, fit the slots 78 loosely. As was pointed out in the copending Application, the screw and nut will be biased in only one direction during operation so the looseness will not be apparent during operation. For simplicity and reliability, pins 82 slide, rather than roll, in slots (or threads) 78 of screw 70.

With nut 80 in place on screw 70, pins 82 engage thread 78 of screw 70. Screw 70 turns to take up the slack and bear against pins 82. In taking up the slack, slots 78 are rotated out of concentricity with pins 82 so that only the top edge of the first milled slot bears against the pins 82. Where the original top edge of the first milled slot has been removed by the second (wider) mill, the top edge of the remaining first milled slot will bear against the pins.

For more precise operation, the screw calculations can be corrected to compensate for the fact that as the bearing radius decreases, the angle through which the screw takes up slack increases. This correction is similar to that for the screw preferred in the copending Application.

Compact Venetian Blind Tilter

The most common tilters for venetian blinds are situated along the axis of the headrail. In the present Invention and in the copending Application, the cord winding tube, spring, and/or other unusual hardware preferably occupies much of the area about the axis of the headrail. In order to limit headrail size, it is advisable to incorporate a compact tilt assembly.

Ordinary venetian blind tilt assemblies are mounted directly over the ladders and lift cords. In the present Invention and in the copending Application, it is also beneficial to run the lift cords straight up to reduce friction in the lifting operation.

A compact tilt assembly 90 is shown in plan in FIG. 9. Crank arms 92, connected to each other by connecting rods or cables 94, are caused to rotate with worm gear 98 (which is attached to the crank arm 92 on the same shaft) by worm 99. The worm gear set cannot be back driven and so holds the tilt position once it is adjusted.

Venetian blind tilt cords 24 (the top ends of the venetian blind ladders) are brought up into the headrail in which the tilt assembly 90 is mounted, passed over rotating pins 96 (such as are known in the art), and connected (as by means of crimped sleeves) to the connecting rods or cables 94.

As the worm gear 98 is rotated back and forth, the tilt cords 24 closest to the window and those closest to the room are alternately pulled.

The cables 94 move toward each other just as the ladder cords do when the venetian blind slats are tilted (particularly if the width of the crank arms is similar to the width of the slats). A similar arrangement, using a cable loop and pulleys (with the cable loop attached at its extreme ends) rather than crank arms, has advantages in some embodiments, particularly where the change in tilt cord spacing may not be desireable. To allow operation over greater than 180°, the cable may make several turns around each pulley. Longer horizontal runs of the tilt cords 24, before they are attached to the connecting rods or cables 94, will compensate for misalignment between the tilt cord and cable positions.

Venetian blind lift cords 22 pass through the center of the tilt assembly 90 without interference.

The blind mechanism, disclosed herein and in the copending Application, allows the blind to be lifted merely by raising the blind's bottom bar and to be lowered by pulling down on the bottom bar. It would be convenient to be able to tilt the bottom bar to tilt the slats, but a conventional venetian blind rigging does not allow that to be done easily.

It is, however, increasingly common to use (particularly, low voltage) motors to tilt venetian blinds. These are commonly operated from portable remote controls. If conductive lift cords (or ladders) are used, controls for the tilt (at least) can be located in the bottom bar. No separate controller and batteries are needed.

Balancing Bar

FIG. 10 shows a bottom bar 100 for a window blind which is raised by lift cords 22 (such as a venetian blind, Roman shade, or cellular shade). The bottom bar 100 comprises pulleys 104 and a capstan 106 operated by knob 108. Lift cords 22 pass under the pulleys 104 to the capstan 106 whereon they may be wound (and whereoff they may be unwound). Various methods to prevent the capstan from slipping, including ratchet, worm drive, or slip clutch may be applied.

This disclosure and the copending Application describe a mechanism whereby a window blind can be maintained in equilibrium throughout its travel. The balance can be biased so that the blind will be easier to lower or easier to lift. This can be accomplished in the design of the critical component (i.e., the screw) or by adjusting the angular relationship between the screw and the winding tube.

A designed-in bias is not adjustable after the fact. On site adjustment of the angular relationship between the screw and the winding tube may not be trivial and (even if an external adjuster is provided) will probably require a step-ladder. However, adjusting the cord length at the bottom bar is equivalent to changing the angular relationship between the balance and the winding tube. The bottom bar is easy to reach and the adjustment is simple.

Incidentally, shortening the cords in this way is not equivalent to shortening the blind by removal of slats and remounting the bottom bar. In that case the mechanism will operate normally, as if the slats had not been removed.

The method of balance disclosed herein can be used to easily fine tune the balance of the blind. Extreme adjustment can skew the balance so that the blind raises or lowers by itself. In that case, a spring return to center the trim control is recommended. If the lift cords are wound onto a capstan powered by a bimetal strip, the blind can be made to rise or fall in response to temperature.

Parallel Winder

It is particularly advantageous to design a standardized screw assembly to allow a wide range of loads to be accomodated. The number of different types and sizes of parts should be minimized so that manufacturing costs can be controlled.

For a particular class of loads, a product line of two-inch wood slat venetian blinds for example, an assembly can be designed by the method disclosed to accomodate the widest expected blind with the greatest expected length. The assembly can then be customized simply by selecting an appropriate spring.

It should be noted that the design will be far more sensive to length than it will be to width. The work needed to lift a blind is proportional to its width and to the square of its length. Weight added by making a blind longer must also be lifted a greater distance. It follows that particularly long blinds may be better accomodated by a second or custom design.

However, in order to be useful for smaller blinds, the screw assembly must fit into headrails of considerably narrower blinds than the widest and longest blinds which primarily control the design. If the design is thus further constrained, it may be necessary to develop an inordinately fat design so that sufficiently powerful springs (for wide blinds) may be accomodated.

Working from a theoretical blind of twice the minimum expected width and the maximum expected length, a more economical standardized product design is developed. The screw assembly is designed, according to the disclosure, such that it is no wider than the minimum expected headrail, but can accomodate the theoretical blind of twice that width.

If, in the example of a line of two-inch wood slat venetian blinds, the minimum desired width is three feet, the design solution should be based on the load presented by a blind six feet wide and of the maximum desired length (of any blind in the proposed product line). The screw assembly should, of course, be no wider than three feet. Simply by installing appropriate springs, the assembly will be able to accomodate any blind from three to six feet wide. Where the blind is wider than the screw assembly, lift cords may be passed over pulleys and brought to the winding tube.

Blinds over six feet wide can be accomodated by installing more than one screw assembly into the headrail. Two screw assemblies are sufficient for blinds up to twelve feet wide, three screw assemblies will manage blinds up to eighteen feet wide, etc. Blinds shorter than the maximum length will simply operate using less than the full length of the variable pitch screws.

Although a blind balanced by a plurality of screw assemblies will theoretically tend to level itself, it is prudent to link the screw assemblies to insure parallel operation. A preferred linkage, which is economical, which easily accomodates any spacing, which can be easily arranged to avoid conflict with structures and parts within the headrail, and which requires essentially no special or additional design, is shown in FIG. 11.

A length of cable 114 is wound several times (at least as many times as the winding tube will rotate in operation of the mechanism) about the winding tube 32 of a first screw assembly 30. A point on the length of cable 114 is fastened to the tube 32 by a screw 116 or other convenient means. The ends of the length of cable 114 are passed under (or over) pulleys 112 (four pulleys are shown, but any convenient number may be used) such that the cable ends are brought to the second winding tube 32 in reversed positions (i.e., one cable end passes from the rear of the first winding tube to the front of the second winding tube, the other cable end passes from the front of the first winding tube to the rear of the second winding tube). The ends of the cable 114 (all the while being held taut) are then each wound several times about the second winding tube 32 and fastened to the tube 32.

Note that the pairs of pulleys 112 are not on common axes, but are offset by the lengths of the wraps of cable 114 on winding tubes 32.

In operation, depending on the direction of rotation, the cable 114 is unwound from the rear of one tube 32 and onto the front of the other and vice versa. Thus, parallel rotation of the tubes 32, as lift cords 22 are wound and unwound, is insured.

While the invention has been described with reference to preferred embodiments thereof, it will be appreciated by those of ordinary skill in the art that various modifications can be made to the structure and operation of the invention without departing from the spirit and scope of the invention as a whole.

I claim:

1. Apparatus to balance a first force against a second force wherein the ratio between the first force and the second force, as said first and second forces vary with respect to one another, is variable and calculatable, comprising, a threaded tapered screw, the screw having a pitch which is proportional to said ratio;

a follower, adapted to engage the thread of the screw and to translate longitudinally and rotate with respect to the screw; whereby the first and second forces may be maintained substantially in balance when the apparatus is operationally connected to the first and second forces; and a hollow tubular screw extension connected to and extending axially and longitudinally from the larger end of the tapered threaded screw, whereby, during operation of the apparatus to balance the first and second forces, torque tends to be applied to the larger end of the screw.

2. Apparatus to balance a first force against a second force wherein the ratio between the first force and the second force, as said first and second forces vary with respect to one another, is variable and calculatable, comprising, a threaded screw, the screw having a pitch which is proportional to said ratio;

a follower, adapted to engage the thread of the screw and to translate longitudinally and rotate with respect to the screw; whereby the first and second forces may be maintained substantially in balance when the apparatus is operationally connected to the first and second forces; and wherein, the screw threads of said screw comprise a continuity of radii, such that, during operation of the apparatus, as the follower translates along the screw and changes position with respect to the screw, the area of engagement between the screw and the follower for each position of the follower along the screw comprises a continuity of radii.

3. The apparatus of claim 2, wherein the screw comprises a grooved bar.

4. The apparatus of claim 3 wherein the grooved bar is a grooved cylindrical bar.

5. The apparatus of claim 4, wherein the grooves of the grooved cylindrical bar comprise a profile which varies along the length of the groove.

6. The apparatus of claim 2, further comprising a cord winder, coupled to transmit one of said forces to the apparatus;

at least one lift cord, attached to the cord winder, a load, suspended on said at least one lift cord, and cord takeup means, suspended with the load, whereby the at least one lift cord may be shortened.

7. The apparatus of claim 6, comprising at least two lift cords, wherein said cord takeup means operates simultaneously on at least two of said lift cords.

8. Apparatus to balance a first force against a second force wherein the ratio between the first force and the second force, as said first and second forces vary with respect to one another, is variable and calculatable, comprising, a first balancing mechanism comprising a first threaded screw, the screw having a pitch which is proportional to said ratio; and a first follower, adapted to engage the thread of the first threaded screw and to translate longitudinally and rotate with respect to the first screw;

a second balancing mechanism comprising a second threaded screw, the screw having a pitch which is proportional to said ratio;

a second follower, adapted to engage the thread of the second threaded screw and to translate longitudinally and rotate with respect to the second screw, whereby the first and second forces may be maintained substantially in balance when the apparatus is operationally connected to the first and second forces; and a cord winder for each of the first and second balancing mechanisms, each said cord winder being coupled to its respective balancing mechanism to transmit one of said forces to its balancing mechanisms, and a length of cable wound on the cord winder for each of the first and second balancing mechanisms, such that in operation of said apparatus, operation of the respective cord winders is synchronized.

9. An apparatus for balancing a varying load, comprising:

a cord winder;

a lift cord, attached to the cord winder, and to the varying load, whereby the varying load is suspended from the lift cord; and cord winding means, suspended with the varying load, whereby the lift cord may be shortened.

10. The apparatus of claim 9, comprising plural lift cords and wherein said cord takeup means operates simultaneously on said lift cords.

* * * * *